United States Patent [19]

Balland

[11] 4,199,320

[45] Apr. 22, 1980

[54] WHITENING OF CELLULOSIC TEXTILES

[75] Inventor: Jean Balland, Chateaurenault, France

[73] Assignee: Manufacture de Products Chimiques Protex, Paris, France

[21] Appl. No.: 4,055

[22] Filed: Jan. 16, 1979

[51] Int. Cl.[2] ..... D06M 1/02

[52] U.S. Cl. ..... 8/139; 8/116 P; 8/125; 8/147; 260/502.4 P; 260/502.5

[58] Field of Search ..... 8/139, 116 P, 125, 147; 260/502.4 P, 502.5

[56] References Cited

U.S. PATENT DOCUMENTS

| | | | |
|---|---|---|---|
| 3,833,517 | 9/1974 | Kling et al. | 252/545 |
| 4,092,108 | 5/1978 | Valko et al. | 8/116 P |

FOREIGN PATENT DOCUMENTS 2262301 7/1974 Fed. Rep. of Germany .

*Primary Examiner*—William E. Schulz
*Attorney, Agent, or Firm*—Browdy and Neimark

[57] ABSTRACT

Cellulose fiber textiles are whitened by boiling in an aqueous alkaline solution containing 0.1 to 10% by weight of a hydrazine phosphonate or a hydrazine alkali phosphonate.

7 Claims, No Drawings

WHITENING OF CELLULOSIC TEXTILES

FIELD OF THE INVENTION

The present invention relates to improvements in the boiling or hydrophylizing of textiles of cellulose fibers or containing fibers of cellulose.

BACKGROUND OF THE INVENTION

Boiling of cellulose fibers constitutes an important operation in improving cellulose textiles. It is known that this operation, performed in an alkaline medium, eliminates foreign matter in the natural fibers and makes the fibers hydrophilic.

An attempt has often been made to improve the effectiveness of the alkaline treatment, at the same time as the saponification of the waxes and natural greases of the fibers, to increase the level of whiteness and elimination of hulls and dark colorants from the fibers and to permit a better extraction and a better elimination of inorganic materials also appearing in considerable amounts as impurities of the fibers. It has been proposed to use alkaline metal polyphosphates or aminopolycarboxylic acid salts in the alkaline boiling baths to increase particularly the extraction of the inorganic substances from the fibrous material.

The use or reducing compounds such as sodium dithionite or the salts of α-hydroxy-alkane-sulfinic acids has also been recommended in the boiling procedure to increase the degree of whiteness. It is known that if the presence of these compounds in the alkaline bath is such that no undesirable oxidation of the fiber occurs, then their effectiveness on the degree of whitening is not very great.

SUMMARY OF THE DISCLOSURE

It has now been observed that the use of hydrazine phosphonates, compounds produced by the reaction of phosphonic acid derivatives with hydrazine or hydrazine hydrate, in alkaline boiling baths makes it possible to increase clearly the effectiveness of the treatment.

The present invention therefore has for an object the improvement in the processes of boiling and hydrolyzing of cellulose fibers in an alkaline medium according to which the treatment is performed in the presence of a hydrazine phosphonate or a double phosphonate of hydrazine and another cation.

DETAILED DESCRIPTION OF EMBODIMENTS

According to a preferred aspect of the present invention, the double phosphonate used is a phosphonate of hydrazine and sodium, potassium, lithium, ammonium or amine, these compounds being obtained by partial salification of a phosphonic acid derivative by hydrazine or hydrazine hydrate, followed by a complete neutralizing of the acid compound by the base of a second element, such as sodium hydroxide.

It can be established that the addition of these compounds makes it possible, besides protecting the fibers from any oxidation, to eliminate the dark colorants (i.e. puces) and obtain a level of whiteness of the article treated greater than the results that can be registered by use of reducing compounds usually recommended, such as those cited above.

It can also be observed that the results obtained by alkaline boiling in the presence of hydrazine phosphonates are greater, i.e. better, than those obtained by using equivalent amounts of the constituents of the compound when these constituents are applied separately; for example, by use, on the one hand, of hydrazine alone, followed, in another bath, by use of a sodium phosphonate. This observation shows the completely unexpected synergistic phenomenon of the hydrazine phosphonate products.

According to a preferred embodiment of the invention, the phosphonates are derivatives of amino (lower alkane) polyphosphonic acids and/or derivatives of hydroxy-alkanephosphonic acids. There can be cited as types of amino (lower alkane) phosphonic acids certain compounds deriving from $C_1$ to $C_4$ hydrocarbons such as, for example, aminomethane diphosphonic acid, amino-bis-methylene phosphonic acid, diethylenetriaminopentakis methylene phosphonic acid, ethylene diamine tetrakis methylene phosphonic acid, 1-aminomethylcyclopentylamine-2-tetrakis methylene phosphonic acid, and 1,2-cycohexane tetrakis methylene phosphonic acid. As types of hydroxy alkane phosphonic acids, there can be cited certain derivatives of $C_1$ to $C_4$ hydrocarbons such as, for example, hydroxy ethane 1,1-diphosphonic acid, and 1-hydroxy propane-1,1,3-triphosphonic acid.

It has further been observed that the synergistic effect mentioned above is clearly greater when the hydrazine content is between 1 and 50% by weight and preferably between 2 and 20% by weight in relation to the phosphonic acid derivative considered, expressed in its acid form.

The boiling of hydrophilization aqueous bath in a standard way contains:

- 0.1 to 20% by weight of an alkaline agent, generally an alkali hydroxide and preferably sodium hydroxide;
- 0.1 to 5% by weight of a wetting agent resistant to alkaline treatments and currently used in alkaline boilings such as, by way of example, the condensation products of fatty acids, sulfated oils and fats, alkyl and alkyl aryl sulfonates, sulfated polyglycol ethers, polyglycol ethers of fatty alcohols, alkyl aryl polyglycol ethers.

In accordance with the invention there is advantageously added:

- 0.1 to 10% by weight of a hydrazine phosphonate or a double phosphonate of hydrazine and another cation.

Treatments according to the invention will be performed according to the conditions usually observed in boiling or hydrophilization of fibers, whether the so-called continuous process or various processes of treatment in retaining baths are involved.

Certain examples of application given below by way of non-limiting examples will make it possible to better understand and to define more concretely the possibilities of the invention. In these examples all concentrations are expressed in grams per liter of bath.

EXAMPLE 1

Samples of previously desized and dried raw cotton fabric samples were treated in baths having the following compositions:

(A) 40 g of sodium hydroxide 5 g of a wetting agent constituting the product of reaction of nonyl phenol with 10 moles of ethylene oxide.

(B) Same bath as bath A to which was added:

30 g of a double phosphonate of hydrazine and sodium having a hydrazine content of 15.5% in relation to the weight of the phosphonic acid, and obtained by partial salification of a molecule of hydroxy ethane-1,1-diphosphonic acid with a molecule of hydrazine in the form of an 80% hydrazine hydrate, then by neutralization of the resulting compound with sodium hydroxide.

(C) Same bath as bath A to which was added:

3.9 g of 80% hydrazine hydrate so as to introduce as amount of hydrazine identical with that introduced in bath B in salified form.

(D) Same bath as bath A to which was added:

29 g of a sodium phosphonate obtained by neutralization with sodium hydroxide of hydroxy ethane-1,1-diphosphonic acid, so as to introduce, in the form of sodium salt, an amount of phosphonic acid identical with that of bath B.

After impregnation in the various baths above, the treating liquids were pressed out from the samples by passage between rolls of a press so as to retain an amount of the bath corresponding to only 90% of the weight of the sample, and then the wet samples were subjected to steaming in saturated steam for an hour at a temperature of 100° C. After treatment each sample was rinsed under identical conditions, first in hot water, then in cold water, then acidified with a 5% acetic acid solution, and finally rinsed in cold water before drying.

Inspection of the resulting samples first of all showed a practically total elimination of the dark colorants (puces) on the sample treated in bath B, whereas the three other samples still very clearly showed the presence of numerous puces. In regard to the degree of whiteness, it also appears very clearly that the sample treated in batch B exhibited a whiteness level greater than that of the three other samples. Measurement of the degree of whiteness determined with an Elrepho apparatus made it possible to register the following remission values:

Bath A: 76.3%
Bath B: 81.7%
Bath C: 77.5%
Bath D: 77.2%

EXAMPLE 2

A previously desized and dried raw cotton fabric was impregnated in baths having the following composition:

(A) 40 g of sodium hydroxide
5 g of the wetting agent of example 1

(B) Bath A to which was added:

40 g of a double phosphonate of hydrazine and sodium having a hydrazine content of 22% in relation to the weight of the phosphonic acid considered, obtained by partial salinification of a molecule of amino-tris (methylene phosphonic) acid with a molecule of hydrazine introduced in the state of 80% hydrazine hydrate, followed by neutralization of the resulting acid compound with sodium hydroxide.

(C) Bath A to which was added:

3.7 g of 80% hydrazine hydrate, which made it possible to introduce an amount of hydrazine equivalent to that which was introduced in the preceding bath B in salified form.

(D) Bath A to which was added:

38 g of the sodium salt of the phosphonic acid derivative used to prepare the product of bath B, which made it possible to introduce an equivalent amount of phosphonic acid derivative.

After impregnation, followed by expressing under the conditions of example 1, the samples were treated in steam fo 20 minutes at a temperature of 115° C. After rinsing, acidification and drying, the following results were found:

total elimination of puces on the sample treated in bath B. The presence of still clearly visible puces on the other three samples.

an improved degree of whiteness of the sample treated in bath B. The reemission values, measured on an Elrepho apparatus, were the following:

Bath A: 78.6%
Bath B: 84.5%
Bath C: 80.0%
Bath D: 79.4%

EXAMPLE 3

Samples of previously desized and dried cotton fabric were treated in baths having the following composition:

(A) 8 g of sodium hydroxide
2 g of the wetting agent used in example No. 1.

(B) identical with bath A to which was added:

4 g of double phosphonate of hydrazine and sodium used in example No. 1, having a hydrazine contant of 16.5% by weight in relation to the phosphonic acid derivative, which made it possible to introduce into the bath 0.4 g of hydrazine and 2.7 g of the phosphonic acid derivatives in its acid form.

(C) identical with bath A to which was added 0.4 g of hydrazine.

(D) identical with bath A to which was added 2.7 g of the phosphonic acid derivative previously neutralized with sodium hydroxide.

(E) identical with bath A to which was added 4 g sodium salt of $\alpha$-hydroxy methane sulfinic acid.

The samples were treated in the different baths for 1 hour while keeping the temperature at 95° C., the bath ratio being 1 to 10. After rinsing, acidification and drying, the following results were found:

practically total elimination of the puces of the fiber on the sample treated with batch B; presence of puces was, on the other hand, still very clearly visible on all other samples.

as in the preceding examples, determination of the level of whiteness showed a very considerable improvement of this characteristic by treatment in the presence of hydrazine phosphonate. The reemission values were the following:

Bath A: 78.5%
Bath B: 85.2%
Bath C: 80.3%
Bath D: 79.6%
Bath E: 81.2%

EXAMPLE 4

The conditions of example 3 were repeated, using the following baths:

(A) 8 g of sodium hydroxide;
2 g of wetting agent; and
3.7 g of double phosphonate of hydrazine and sodium used in example 3 so as to introduce in the bath 0.38 g per liter of hydrazine and 2.5 g per liter of phosphonic acid derivatives expressed in its acid form.

(B) 8 g of sodium hydroxide;

2 g of wetting agent; and 1 g of a hydrazine phosphonate having content in hydrazine of 62% by weight in relation to the phosphonic acid derivative obtained by reaction of 4 molecules of hydrazine with a molecule of hydroxy ethane-1,1-diphosphonic acid. This derivative therefore made it possible to introduce an amount of hydrazine equivalent to that of bath A, namely 0.38 g per liter; on the other hand, the content of the phosphonic acid derivative was relatively less, i.e. 0.6 g per liter as against 2.5 g/l in bath A.

After treatment, the results showed a very notably greater level of whiteness with formula A and made it possible more precisely to illustrate the influence of the relationship between the hydrazine content and that of the phosphonic acid derivative. The following reemission values were registered:

Bath A: 85%

Bath B: 82.5%

It will be obvious to those skilled in the art that various changes may be made without departing from the scope of the invention and the invention is not to be considered limited to what is described in the specification. For example, it will be understood that the textile may be treated in yarn form, if desired, and that other agents may be added to the treatment bath.

What is claimed is:

1. In a process of boiling and hydrophilizing of cellulose fibers in an alkaline medium, the improvement wherein the treatment is performed in the presence of a hydrazine phosphonate or a double phosphonate of hydrazine and another cation.

2. A process according to claim 1 wherein the double phosphonate used in a phosphonate of hydrazine and sodium, potassium, lithium, ammonium or amine.

3. A process according to claim 1 or claim 2 wherein the phosphonate is selected from amino alkane phosphonic acid salts from $C_1$ to $C_6$ hydrocarbons or from hydroxyalkylane phosphonic acid salts from $C_1$ to $C_4$ hydrocarbons.

4. A process according to claims 1 or 2 wherein the hydrazine content of the compound used is between 1 and 50% by weight in relation to the phosphonic acid used.

5. A process in accordance with claim 4 wherein said hydrazine content is between 2 and 20% by weight of the phosphonic acid reactant.

6. A process according to claims 1 or 2 wherein the content of hydrazine phosphonate in the boiling bath is between 0.1 and 10% in relation to the weight of the bath.

7. In an aqueous textile treating bath for the whitening of cellulose fibers, and containing an alkaline material, the improvement wherein said bath contains 0.1 to 10% by weight of a hydrazine phosphonate or a hydrazine alkali phosphonate wherein the hydrazine content thereof comprises between 1 and 50% by weight in relation to the phosphonic acid reactant.

* * * * *